United States Patent [19]

Stahlhut et al.

[11] 4,008,654

[45] Feb. 22, 1977

[54] ADJUSTABLE AIR BLADE FOR AIR HANDLING LUMINAIRES

[75] Inventors: Leo G. Stahlhut, Kirkwood; Walter J. Trantina, St. Louis, both of Mo.

[73] Assignee: Emerson Electric Co., St. Louis, Mo.

[22] Filed: June 4, 1975

[21] Appl. No.: 583,702

[52] U.S. Cl. ..... 98/40 DL; 240/9 A

[51] Int. Cl.[2] ..... F24F 13/02

[58] Field of Search ..... 98/40 DL, 40 C, 40 D, 98/41 R, 106; 251/285, 298; 137/525.3; 240/9 A

[56] References Cited

UNITED STATES PATENTS

| | | | |
|---|---|---|---|
| 2,985,090 | 5/1961 | Quin | 98/40 DL |
| 3,126,811 | 3/1964 | Kennedy | 98/40 D |
| 3,181,450 | 5/1965 | Kruger | 98/40 DL |
| 3,185,069 | 5/1965 | Straub et al. | 98/40 D |
| 3,295,432 | 1/1967 | Palmquist | 98/40 D |
| 3,308,744 | 3/1967 | Schach | 98/40 D |
| 3,419,714 | 12/1968 | Slauer | 98/40 DL |
| 3,838,268 | 9/1974 | Fabbri | 98/40 DL |

*Primary Examiner*—John J. Camby
*Assistant Examiner*—Henry C. Yuen
*Attorney, Agent, or Firm*—Polster and Polster

[57] ABSTRACT

A multipurpose, recessed luminaire capable of utilization in air handling applications is provided having a simplified air blade construction. The particular construction utilized in the air blade design is responsible for the ability of the luminaire to exhibit a multipurpose capacity. The luminaire or light fixture includes a body defining a lamp housing. The body has a peripheral lip about it, the lip defining a cavity along at least two opposed sides of the body. The cavity is the primary air path when the luminaire is used in air transfer applications. The air blade is mounted along the peripheral lip and is adjustable between positions which block air flow, provide horizontal air distribution, or provide vertical air distribution, horizontal and vertical distribution referring to the general direction of air flow travel after exiting the cavity. The air blade inlcudes a first wall, a second wall initially generally perpendicular to the first wall, and a third wall meeting the first wall at a predetermined angle. In the preferred embodiment, both the first and third walls have relief means formed in them so that these walls may be folded against one another and against the second wall to give the luminaire its multipurpose capabilities. The third wall is designed to function as a positive blade stop in the horizontal air distribution position of the air blade.

11 Claims, 7 Drawing Figures

ADJUSTABLE AIR BLADE FOR AIR HANDLING LUMINAIRES

BACKGROUND OF THE INVENTION

This invention relates to luminaire construction and in particular to a novel air blade design for use in air handling luminaires having multipurpose capabilities. While the invention is described in detail with respect to a particular luminaire or lighting fixture design, those skilled in the art will recognize the wider applicability of the air blade construction disclosed.

Buildings of various types commonly utilize fluorescent lighting fixtures or luminaires, designations used interchangeably in this specification, for various functions. Thus, the architectural specifications for lighting installation may call out a non-air handling unit for one particular area, while other areas may require a fixture capable of air supply, air return, heat transfer or combinations of these functions. In order to meet this multi-application demand, the lighting fixture structure is arranged so that it can be adapted for any of the above uses by relatively simple modification. In general, the fixture modifications are designed so that they may be accomplished by field personnel at the particular job site. Fixture manufacturers thus are able to build and store single fixture models which are adaptable to a variety of uses.

A number of luminaire designs are known in the art which are capable of multipurpose uses. In one commercially successful prior art design, the lighting fixture includes a peripheral lip defining a cavity. The lip has a top wall having a plurality of openings in it. The openings are intended to receive a connector from an appropriate air supply when the fixture is used in its air supply mode. Because the unit is manufactured initially as a non-air handling unit, the openings are closed by connection knockouts. That is, the openings as manufactured, have metal portions closing them, the metal portions being removed when use of the openings is required. An air blade also is provided with the fixture. In this particular prior art design, the air blade was mounted in the cavity defined by the lip so as to give a horizontal distribution to air passing through the cavity. Vertical air distribution required the removal of the air blade from the cavity. While this form of fixture works well for its intended purpose, the removal of the knockouts, and the necessary removal of the air blade when vertical air distribution is desired, are relatively time consuming and expensive on site installation procedures.

In order to eliminate the requirement for knockouts as a feature of the lighting fixture structure, various adjustable air blades have been designed which are movable between a first position which closes the openings in the lip of the fixture and at least two other positions corresponding to blade setting for horizontal and vertical air distributions. While this type of design again works well for its intended purpose, the air blade construction is relatively expensive from the manufacturers standpoint.

Our invention resolves these prior art difficulties by providing an air blade construction which may be used to close the air admitting openings in the lip of the fixture, which may be positioned easily to provide either horizontal or vertical air distribution, and which is more economical to manufacture than other known prior art air blade designs.

One of the objects of this invention is to provide a simplified air blade construction for utilization in a multipurpose luminaire.

Another object of this invention is to provide a low cost air blade design.

Yet another object of this invention is to provide an air blade design in which individual sections of an overall air blade may be moved independently of other sections of the overall air blade design.

Other objects of this invention will be apparent to those skilled in the art in light of the following description and accompanying drawings.

SUMMARY OF THE INVENTION

In accordance with this invention, generally stated, a multipurpose luminaire capable of use in a variety of air handling applications is provided with a simplified, adjustable air blade. In the preferred embodiment, the luminaire includes a body defining the lamp housing. A peripheral lip extends along at least two sides of the body. The lip has a top wall, a side wall and an open bottom. The top wall has a plurality of openings in it which are utilized to attach an air supply to the fixture. An air blade having a plurality of sides is mounted to the fixture so that a first side of the blade closes the openings in the top wall. A second side is adjacent to and meets the first side at some predetermined angle. The first side of the air blade has at least one relief means formed in it. The relief means permits the first side to be adjusted with respect to the openings. The second adjacent side also may have at least one relief means formed in it, thereby permitting further adjustment of the first side with respect to the openings. The first and second sides of the blade preferably are constructed so that preselected portions of the lip may be used for one purpose while other portions of the lip are used for another purpose.

DESCRIPTION OF THE PREFERRED EMBODIMENT

Figure 1:
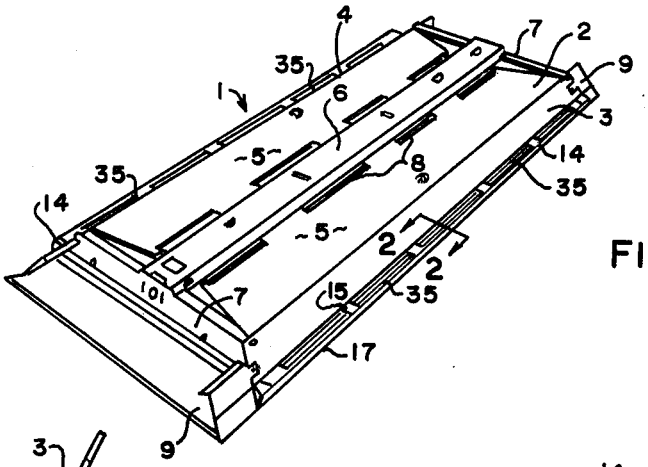
FIG. 1 is a view in perspective of one illustrative embodiment of luminaire employing our invention.

Referring now to FIG. 1, reference numeral 1 indicates a luminaire or lighting fixture employing our invention. The luminaire 1 includes a body 2 having some predetermined design silhouette. As will be appreciated by those skilled in the art, it is conventional to vary the length and width dimensions of the body 2 so as to provide a family of fixtures which will fit a series of openings in a ceiling or the like, individual structural features of each luminaire of the family being substantially similar.

In the particular luminaire 1 shown, the body 2 includes a first side wall 3, a second side wall 4, and a top wall 5. The walls 3, 4 and 5 form a frustum in this particular embodiment, other shapes being compatible with our invention. The walls 3, 4 and 5 define a lamp compartment 40. The compartment 40 contains one or more fluorescent lamps, indicated generally by the numeral 34 in FIGS. 2 and 3. The top wall 5 has a raceway 6 associated with it, which carries and permits access to certain of the electrical components required for luminaire 1 operation. While the top wall 5 is described as a single sheet metal part, it may be constructed from a plurality of parts, if desired.

The body 2 is closed on each end by a pair of end plates 7. The top wall 5 has a plurality of return air louvers 8 in it, which are used in the heat transfer function of the luminaire 1. In that operation, each of the end plates 7 have a light baffle, not shown, associated with it, the light baffle being movable to permit air to enter the lamp compartment 40 side of the body 2 and exit through the louvers 8.

The luminaire 1 includes a pair of panels 9 which may vary in size and which are used to fit the exterior dimensions of the luminaire 1 to a particular application. They may or may not be required, depending on application demands.

A lens frame 10 is insertable in a lower end 39 of the body 2. The lens frame 10 commonly is mounted for pivotal movement with respect to the body 2 by any convenient method. For example, two opposite ends of the frame 10 may be journaled to permit rotation after release of a conventional catch means for holding the frame in its normal position. The lens frame 10 may assume a variety of shapes in cross section. The frame 10 shown includes a receptacle portion 11 which is intended to receive a prismatic light panel 12. The panel 12 also may comprise a variety of commercially available designs and is not described in detail. When properly positioned, the lens frame 10 and panel 12 close the lamp compartment 40, hiding conventional light means, commonly the fluorescent lamps 34, for example, and their associated electrical connections and circuits for operating the fluorescent lamps, from view. While the luminaire 1 illustrated uses the lens frame 10 and panel 12 to close the lamp compartment 40, other means for closing the lamp compartment are known in the art. Closing means primarily are intended to enhance the aesthetic appeal of the luminaire 1. Among other devices useful for this purpose are plastic or aluminum louvered closures, for example, that do not require the addition of a lens panel. Such closures commonly are mounted to the body 2 by methods similar to those described in conjunction with the frame 10.

The body 2 of the luminaire 1 has a lip 14 extending about two oppositely opposed sides of the body 2. The lip 14 includes a top wall 15, a side wall 16, and at least a partially open bottom wall 17. The top wall 15, in the embodiment illustrated, has a plurality of openings 35 in it. The non-open portions of the top wall 15 functioning to attach the lip 14 to the body 2. The lip 14 and the lens frame 10 together define a cavity 18. The openings 35 communicate with the cavity 18 and with the surrounding environment of the luminaire 1 through the bottom 17 of the lip 14. In luminaire designs not using a frame 10, the lip 14 may itself define the cavity 18, or the lip 14 and the closure used in place of the frame 10 may make that definition, for example. In any event, means are provided for permitting air transfer from one side of the luminaire 1, generally above the ceiling to a second side of the luminaire 1, generally at or slightly below the ceiling having the luminaire 1 installed in it.

As thus described, the luminaire 1 generally represents a variety of available light fixtures. The luminaire 1 of our invention differs from prior art designs in the utilization of an air blade 19, which eliminates the need for knockouts closing the openings 35 in the non-air handling applications of the luminaire 1.

Air blade 19 is best described with reference to FIGS. 4–7. As there shown, the blade 19 includes a side 20, a side 21 generally perpendicular to the side 20, and an angled side 22, side 22 being angled with respect and attached to the side 21. The blade 19 has a length dimension determined by its application. That is, length of the blade 19 may vary depending upon the axial length of the luminaire 1.

Blade 19 has a pair of ends 23, only one of which is illustrated in the drawings. Each of the ends 23 has a strengthening rib 24 which functions to increase the structural rigidity of the blade 19. The rib 24 generally is perpendicular to the side 20.

The side 21 of the blade 19 has relief means 26 formed in it. The relief means 26 may be and preferably is a die cut slit made through the side 21. The side 21 is attached to the side 20 along a plurality of tie tabs 27, which result from the predetermined spacing between either successive relief means 26 or between a single relief means and the ends of the side 21 when a single relief means is utilized or when a plurality of relief means 26 terminate along the axial length of the blade 19.

Figure 4:
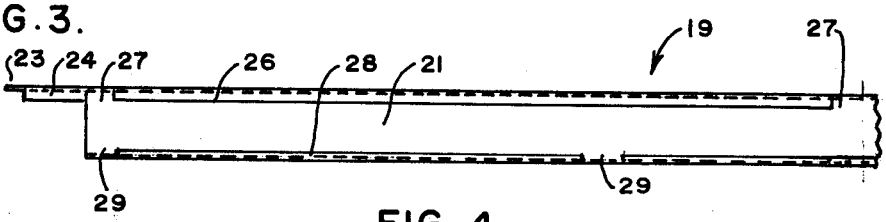
FIG. 4 is a top plan view of the air blade embodiment utilized in conjunction with the fixture of FIG. 1.
Figure 5:
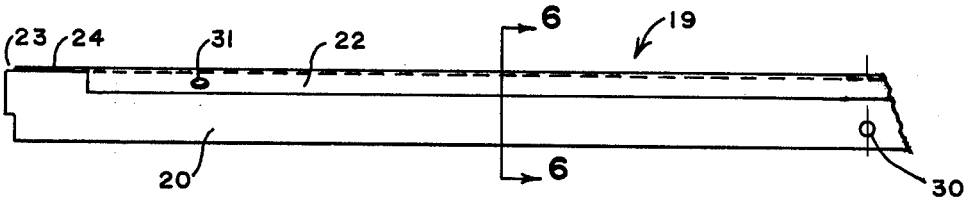
FIG. 5 is a view in front elevation of air blade shown in FIG. 4.
Figure 6:
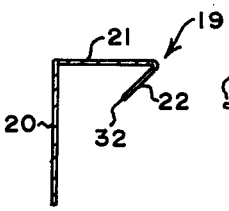
FIG. 6 is a sectional view taken along the line 6—6 of FIG. 5.

In the embodiment illustrated in FIGS. 4–6, the side 21 has a second relief means 28 formed in it, separating the side 21 from the side 22. The sides 21 and 22 are joined to one another along a plurality of tie tabs 29. Preferably, one of the tie tab plurality 27 and 29 are enlarged with respect to the other of tie tab plurality 27 and 29 so that each of the sides 21 and 22 are permitted to act independently of one another, while the sides 21 and 22 retain structural rigidity with respect to one another and to the side 20.

The side 20 has at least one opening 30 in it which is utilized to mount the air blade 19 to the lip 14 of the luminaire 1. Conventional fasteners, for example, inserted through the opening 30 and a corresponding opening in the side 16 of the lip 14 work well. The side 22 also has an opening 31 through it which may be used, if desired, during adjustment of the air blade 19, as later described.

Figure 7:
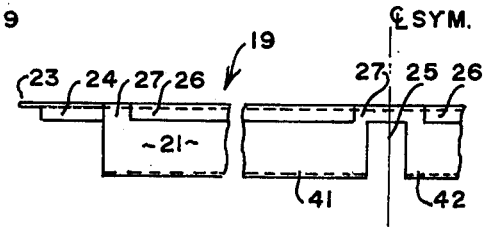
FIG. 7 is a top plan view of a second illustrative embodiment of air blade of this invention.

The embodiment of the air blade 19 shown in FIG. 7 differs from that shown in FIGS. 4–6 in that only the relief means 26 is utilized. However, both the side 21 and the side 22 of the blade 19 have a slot 25 cut through it, dividing the blade 19 into a first portion 41 and a second portion 42. The slot 25 is used to permit the portions 41 and 42 to act independently of one another. That is to say, the portions 41 and 42 may be moved independently of one another for purposes later described. While shown as separate embodiments, those skilled in the art will recognize that the slot 25 also may be used in conjunction with the dual relief means shown in FIG. 4, if desired.

Operation of the blade 19 is relatively simple to understand. As manufactured, the luminaire 1 has the air blade 19 inserted within the cavity 18 defined by the lip 14 and the lens frame 10 or other related structure. Because the side 21 initially is generally normal to the side 20, placement of the blade 19 in the cavity 18 enables the side 21 to block the opening 35 in the lip 14. With the air blade 19 positioned so that the side 21 blocks the openings 35, the luminaire 1 functions as a non-air handling unit.

Figure 2:
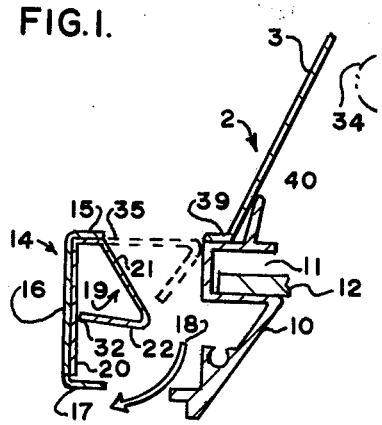
FIG. 2 is a sectional view taken along the line 2—2 of FIG. 1 illustrating a first position and a second position for air blade of our invention.
Figure 3:
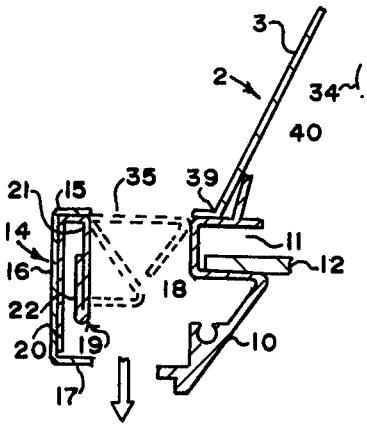
FIG. 3 is a sectional view corresponding to FIG. 2, showing a third position for air blade of our invention.

When air either is to be supplied or returned through the openings 35, then the side 21 is moved to the full line position shown in FIG. 2. The relief means 26 permits the side 21 to bend along the tie tabs 27, so that it is an easy task to move the side 21 between the two positions illustrated in FIG. 2. Movement of the side 21 by bending along the tie tab 27 may be accomplished whether or not the lens frame 10 is removed from the luminaire 1. With the lens frame 10 removed, the side 21 merely is moved to the proper position. When the lens frame 10 remains in the luminaire 1, a tool, not shown, may be placed through the open bottom 17 and inserted in the opening 31. Thereafter, the tool merely is drawn downwardly, downwardly being referenced to FIG. 6 to position the air blade 19 properly, and then disengage from the air blade.

In the air blade 19 position shown in FIG. 2, the side 22 functions as a positive stop for defining proper air blade 19 position for horizontal air distribution. That is, an end 32 of the side 22 will come into abutment with the side 20 of the blade 19 as the side 21 moves between the two positions shown. That abutment prevents further travel of the side 21–22 combination and positions the air blade 19 within the cavity 18 for proper horizontal air distribution.

Two options are available when vertical air distribution is desired. With the embodiment of FIG. 7, where the second relief means 28 is not provided in the air blade 19, the blade 19 is removed from the luminaire 1 to provide the vertical air distribution. With the embodiment of FIG. 4, the side 22 of the blade 19 may be folded against the side 21, along the relief means 28 and the tie tabs 29, resulting in the full line position for the air blade 19 shown in FIG. 3. The embodiment of the air blade 19 shown in FIG. 4 is preferred because of its ability to provide vertical air distribution more easily than the embodiment of FIG. 7. However, even the embodiment of FIG. 7 offers significant cost advantages over air blade designs known in the prior art. In the position of the blade 19 shown in FIG. 3, air from any available supply passes through the openings 35, chamber 18 and open bottom 17 of the lip 14.

The slot 25, while described in conjunction with the blade embodiment shown in FIG. 7, can be adapted for use in other embodiments of our invention. When used, the slot 25 enables the luminaire 1 to have even greater flexibility. For example, the portion 41 may be set for vertical air distribution while the portion 42 is set either for horizontal air distribution or for the non-air handling position where the side 21 of the portion 42 blocks certain ones of the openings 35. Those skilled in the art will appreciate the wide variety of combinations possible with the construction disclosed.

It thus may be observed that the air blade 19 in our invention permits a single luminaire 1 to exhibit a wide range of functional capabilities meeting all the ends and objects of the invention set out above.

Numerous variations, within the scope of the appended claims, will be apparent to those skilled in the art in light of the foregoing description and accompanying drawings. As indicated, the number of relief means may vary. Use of the slot 25, while preferred, is not required for our invention to exhibit superior characteristics when compared to prior art structures. The particular design silhouette of the air blade may be changed. In like manner, while the various relief means were described as die cut, other means or methods for providing relatively easy movement of one or more portions of the air blades may be used, if desired. Although the air blade 19 preferably is constructed from sheet metal, other materials are compatible with our invention. These variations are merely illustrative.

Having thus described the invention, what is claimed and desired to be secured by Letters Patent is:

1. In a lighting fixture including a body, said body having a peripheral lip, said lip having a plurality of openings in it for permitting passage of air through said lip, a wall extending from said lip, said wall defining a lamp housing, said lamp housing having an open side for insertion and removal of an energizable electrical light source, and means for at least partially closing the open side of said lamp housing, said closing means lying inboard of said lip, the improvement which comprises an air blade mounted between said closing means and said lip, said air blade including a first side and a second side, said first side having at least one relief means formed in it, said relief means enabling said first side to move with respect to said second side between at least a first position and a second position, said first side adapted to close the openings in said lip in said first position, said first side and the openings in said lip being spaced from one another in said second position.

2. The improvement of claim 1 further characterized by a third, angled side extending from said first side, said angled side adapted to abut said second side in the second position of said first side.

3. The improvement of claim 2 wherein one of said first and said third angled sides has second relief means formed in it, said relief means permitting movement of said angled side so that said first side may be moved to a third position with respect to the openings in said lip, said third position permitting vertical air distribution for air passing through said lip.

4. A lighting fixture, comprising:

a fixture body, said fixture body including a lamp housing having an open side for permitting insertion and removal of lamp means in said lamp housing, said fixture body having a peripheral lip about it, said lip defining a cavity along at least two opposed sides of said fixture body, said lip having a generally open bottom wall and a top wall, said top wall having a plurality of openings in it;

means for at least partially closing the open side of said lamp housing mounted to said fixture body, said closure means being mounted to said fixture body inboard of said peripheral lip;

lamp means mounted in said housing;

means for electrically connecting said lamp means to a source of electrical energy; and an adjustable air blade mounted to said fixture body along the cavity defined by said lip, said air blade being adjustable between a first position closing the openings in the top wall of said lip, and a second position remote from the openings in said top wall, said air blade including a first side and a second side, said first side being adapted to close the openings in said top wall of said lip in the first position of said air blade, said first side having at least one relief means and a pair of tie tabs formed in it, said relief means and said tie tabs permitting said first side to move between said first and said second positions, said tie tabs attaching said first side to said second side.

5. The lighting fixture of claim 4 wherein said air blade includes a third angled side, said angled side adapted to abut said second side in the second position of said air blade.

6. The lighting fixture of claim 5 wherein said air blade has second relief means and at least a second pair of tie tabs formed in it, said second relief means being formed near said third side, said second relief means permitting said third side to be folded along said last mentioned tie tabs and against said first side, thereby permitting additional movement of said first side.

7. The lighting fixture of claim 5 wherein said first and said third sides of said air blade are arranged in sections, each of said sections having at least said first relief means formed in it, individual ones of said sections being positioned independently of the other ones of said sections.

8. In a luminaire having a body, said body having a lamp housing for receiving lamp means therein, said lamp body having an open side permitting insertion and removal of lamp means, lamp means mounted in said housing, means for electrically connecting said lamp means to a source of electrical energy, means for at least partially closing the open side of said lamp housing thereby hiding said lamp means from view, and a peripheral lip forming a part of said housing, said lip being positioned outboard of said closing means, said lip at least partially defining a cavity along at least two opposed sides of said body, said lip having a generally opened bottom and a top wall, said top wall having a plurality of openings in it, the improvement which comprises an adjustable air blade mounted along the cavity defined by said lip, said air blade being adjustable between a first position blocking the openings in the top wall of said lip and a second position, said air blade including a first side and a second side, said first side being adapted to block the openings in the top wall of said lip in the first position of said air blade, said first side having at least one die cut relief means and a pair of tie tabs formed in it, said relief means permitting said first side to be folded along said tie tabs to move said first side between said first and said second positions.

9. The lighting fixture of claim 8 wherein said air blade includes a third angled side, said angled side being adapted to abut said second side in the second position of said air blade.

10. The lighting fixture of claim 9 wherein said air blade has second die cut relief means and a second pair of tie tabs formed in it, said second relief means being positioned near the junction of said third side with said first side, said second relief means permitting said third side to be folded along said second tie tab pair against said first side.

11. The lighting fixture of claim 10 wherein said first and said third sides are arranged in sections, individual ones of the sections of said first and third sides being positionable independently of the other ones of said side sections.

* * * * *